United States Patent [19]

Gram

[11] Patent Number: 5,040,383

[45] Date of Patent: Aug. 20, 1991

[54] FREEZING PLANT

[75] Inventor: Klaus Gram, Vojens, Denmark

[73] Assignee: Brodrene Gram A/S, Vojens, Denmark

[21] Appl. No.: 474,017

[22] PCT Filed: Oct. 28, 1988

[86] PCT No.: PCT/DK88/00173

§ 371 Date: May 9, 1990

§ 102(e) Date: May 9, 1990

[87] PCT Pub. No.: WO89/03965

PCT Pub. Date: May 5, 1989

[30] Foreign Application Priority Data

Oct. 30, 1987 [DE] Fed. Rep. of Germany ..... 5698/87

[51] Int. Cl.[5] ..... F25C 5/14

[52] U.S. Cl. ..... 62/341; 100/93 P; 100/195

[58] Field of Search ..... 62/341; 100/93 P, 194, 100/195, 199

[56] References Cited

U.S. PATENT DOCUMENTS

| | | | |
|---|---|---|---|
| 2,697,920 | 12/1954 | Mackenzie | 62/341 |
| 3,271,973 | 9/1966 | Amerio et al. | 62/341 |
| 4,240,270 | 12/1980 | McLaughlin | 62/341 |
| 4,553,406 | 11/1985 | Richelli et al. | 62/341 |
| 4,907,421 | 3/1990 | Battistella | 62/341 |

FOREIGN PATENT DOCUMENTS 2145805A 4/1985 United Kingdom .

OTHER PUBLICATIONS

Kühlanlagen, Prof. Dipl.-Ing. Heinrich Drees, Zehnte, vollständig überarbeitete Auflage unter Mitarbeit von Dipl.-Ing. Alfred Zwicker, Mit 269 Bildern, 59 Tafeln und 7 Beilagediagrammen, 17 Mar. 1972 Ver Verlag Technik Berlin.

*Primary Examiner*—William E. Tapolcai

*Attorney, Agent, or Firm*—Watson, Cole, Grindle & Watson

[57] ABSTRACT

A freezing plant consists of a row of plate freezers (1, 2, 3, and 4), a feeding conveyor (5) and a removing conveyor (6). Each of the plate freezers (1, 2, 3, and 4) has a stack of freezing plates and means for stepwise lifting the stack in such a way that interspaces may be provided between the plates for filling and emptying the interspaces. Supporting means serve to support the at any time lowermost plate of the upper part of the stack at the upper limit of the interspace and releasable support means serve to support the at any time uppermost plate of the lowermost part of the stack at the lower limit of the interspace. The disengageable and releasable supporting means are adapted to release the stack for lowering the stack after positioning of the product to be frozen upon each freezing plate. Each plate freezer (1, 2, 3, and 4) moreover, is adapted in such a way that the plates have a freezing period during at least a part of the time during which pressure is applied to the plate stack, and during this period freezing medium is fed to the freezing plates. After the freezing period, a thawing loose period follows during which thawing loose medium is fed to the plates and after this period an inactive period follows for emptying and filling the plate freezer. The number of plate freezers in the series is equal to one plus the sum of the freezing period and the thawing loose period of a plate freezer divided by the inactive period of the plate freezer. A compact frozen product, a continuous feeding of the product to the frozen and a continuous removal of the frozen product is achieved.

8 Claims, 5 Drawing Sheets

FREEZING PLANT

BACKGROUND OF THE INVENTION

The present invention relates to an automatically operated freezing plant comprising a plate freezer having a stack of horizontal freezing plates and stepping means for subjecting the stack to a succession of lifting steps each followed by a smaller lowering step in such a manner as to successively place each plate except the uppermost one at a charging and discharging level. For each step, the respective upwardly next plate is detained at a distance above the charging and discharging level sufficient to permit the charging of freezing goods from one side of the stack into the enlarged interspace between the two plates defining the charging and discharging level. At the same time, simultaneous discharging of frozen goods from the interspace at the other side of the stack occurs. Means are also provided for lowering the whole stack to its original position after freezing and.after frozen goods have been charged into and discharged from the interspace between the lowermost two plates. The plate freezer is combined with a plurality of identical plate freezers to form a series of plate freezers in horizontally aligned arrangement with the charging sides and discharging sides of the stacks situated in common planes.

It is known to use a stepping arrangement as above described in so-called manually operated horizontal plate freezers. In the operation of these, upon lowering of the stack of plates to its original position, a pressure is applied to the stack, whereafter a freezing period is initiated during which the product is frozen followed by a thawing loose period, whereafter the emptying and filling operations are repeated. Such manually operated plate freezer has the advantage that since pressure is applied to the product to be frozen during the freezing period, a compact structure of the frozen material is achieved and, accordingly, air pockets and uneven surfaces are avoided. However, such plate freezer suffers from the drawback that the feeding of the product to be frozen to the plate freezer and the removal of the product must be carried out intermittently because the feeding of the product to and the removal of the frozen product from the plate freezer must be stopped during the freezing period and the thawing loose period.

So-called automatic plate freezers of the kind referred to which allow more or less continuous feeding of the product to be frozen to the freezer and more or less contir.uous removal of the product are disclosed in GB 2,145,805, U.S. Pat. No. 4,240,470 and U.S. Pat. No. 4,553,406. In these known freezers, cooling medium is fed to the plates all the time, and when an emptying/filling cycle has been terminated the whole stack is lowered, whereafter the emptying/filling cycle is repeated immediately or with a minimum of delay. During the freezing the product is not subjected to other pressure forces than the pressure forces which the plates apply to each other. The plate, which at any time forms "ceiling" above the emptying/freezing interspace will be subjected to the pressure from the plates positioned there above, and the plate which at any time is positioned at the bottom of the stack will be subjected to the pressure from the plates arranged there above inclusive the plate which forms "floor" of the emptying/filling interspace. Accordingly, the product positioned below the uppermost plate will at the maximum be subjected to the pressure from this plate and parts which may be connected thereto, if any. Furthermore, since the plate freezer does not have any thawing loose period it may be necessary to use violence upon the frozen product when this is to be removed.

It is the object of the present invention to provide a freezing plant which may operate continuously without the drawbacks connected with the above mentioned automatic plate freezer, and which, accordingly, results in the advantages which are achieved by means of the manually operated plate freezer, and this object is according to the invention achieved by constructing the freezing plant according to the present invention described above. Hereby it is achieved that the freezing plant in question can operate continuously because one plate freezer may be emptied and filled step by step while the other freezers freeze the product in question and provide for thawing the product loose, but in such a way that the next plate freezer is available for commencing its first emptying and filling step immediately after the beforegoing plate freezer has completed its last emptying and filling step. Accordingly, it is achieved that the series may be fed with the product to be frozen in a continuous way and the product may also continuously be removed from the series and an excellent product is achieved because pressure is applied to the product during the freezing period, and due to the thawing loose period the withdrawal of the frozen product causes no difficulties.

A freezing plant consisting of a series of vertical plate freezers is known from Prof. Dipl. Ing. Heinrich Drees, "Kühlanlagen", published 1972 by VEB Verlag Technik Berlin, see pages 273–274. In this known freezing plant the individual vertical plate freezers are in turn subjected to a thawing medium and emptied and then re-filled in a bath-wise operation under the control of the operator. The known freezing plant therefore does not allow for the establishment of an uninterrupted smooth flow of freezing and frozen goods through the freezing plant from an input conveyor to an output conveyor without human attendance.

BRIEF DESCRIPTION OF THE DRAWINGS

The invention will hereinafter be further explained with reference to the drawing, in which FIG. 1 schematically shows a top view of an embodiment of the freezing plant according to the invention.

DETAILED DESCRIPTION OF THE PREFERRED EMBODIMENTS

Figure 1:
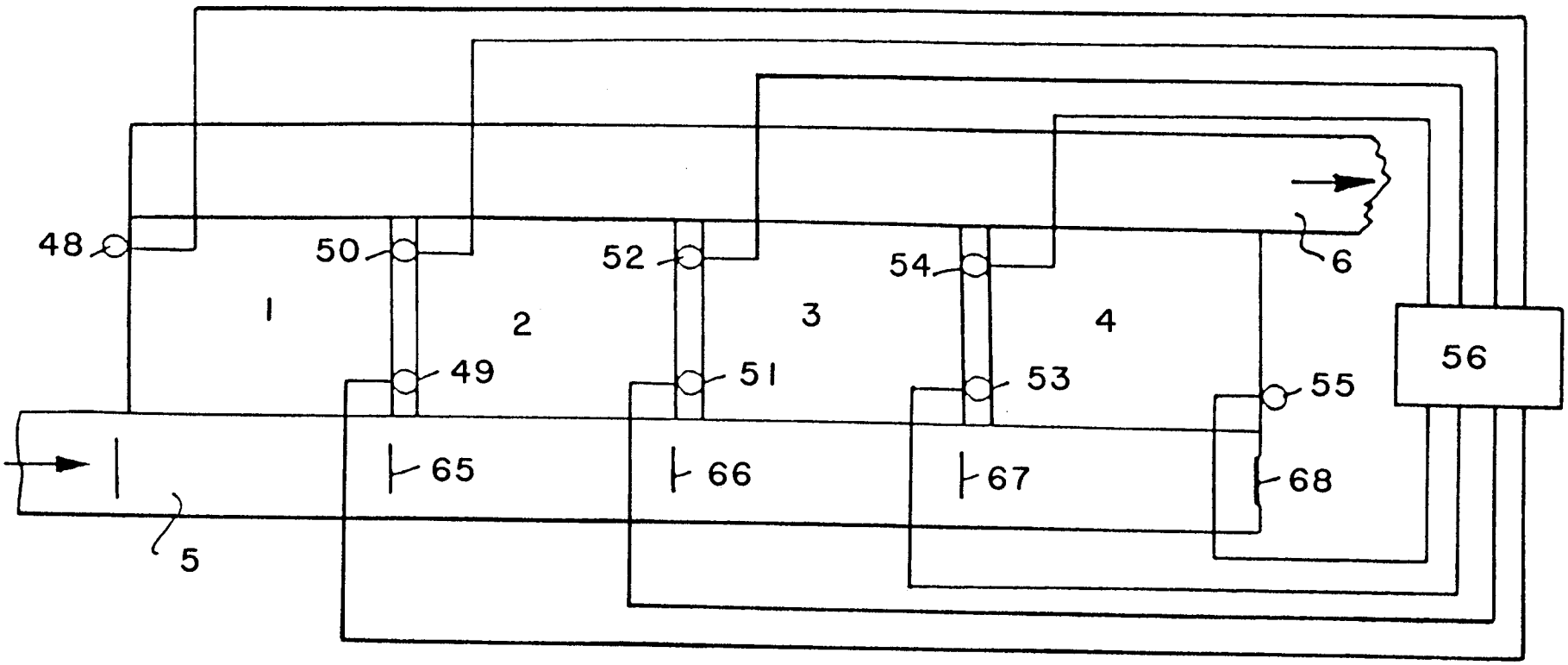
Figure 2:
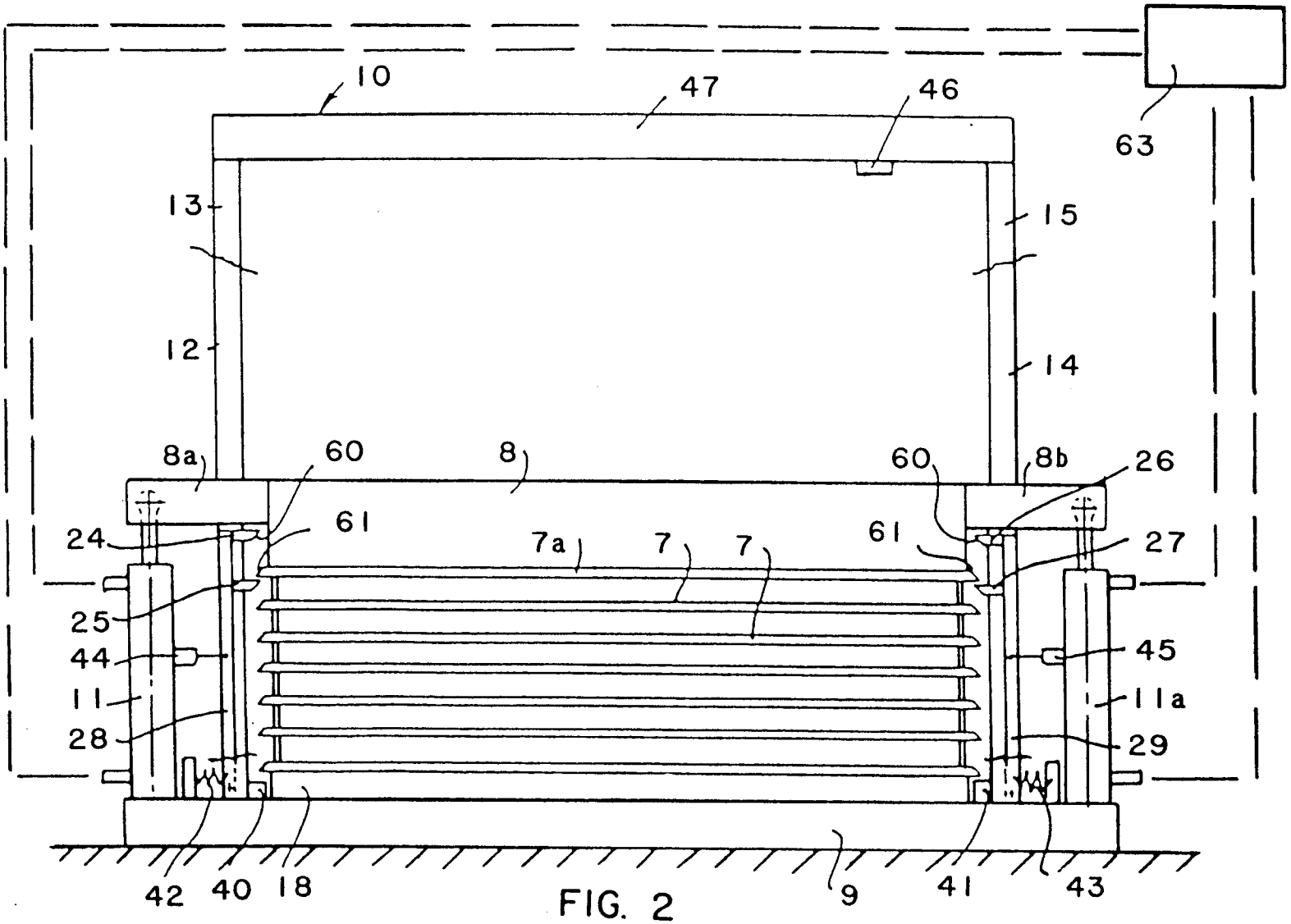
FIG. 2 shows a side view of a plate freezer belonging to the plant in FIG. 1, wherein, however, some parts have been omitted for the sake of clarity.

The freezing plant shown in FIG. 1 consists of four plate freezers 1, 2, 3 and 4 and a conveyor system which according to the embodiment shown consists of a feeding conveyor 5 and a removing conveyor 6. The plate freezers 1, 2, 3 and 4 constitute a series and are according to the embodiment shown aligned with each other in such a way that the feeding conveyor 5 and the removing conveyor 6 may serve all the plate freezers.

As it appears from FIGS. 2-5 each plate freezer, e.g. the plate freezer 1 on FIG. 1, comprises a stack of freezing plates 7 of which seven are provided according to the embodiment schematically shown in FIGS. 1-5.

The uppermost freezing plate 7*a* is supported by means of a cross beam 8 which at each end of the plate freezer has an outwardly extending end 8*a* and 8*b*, respectively, and between each of the ends and a basis 9 for the frame 10 of the plate freezer a double acting hydraulic cylinder 11 and 11*a*, respectively, is arranged.

The cylinders are arranged outside end frame parts each consisting of two columns 12, 13 and 14, 15, respectively. Within each end frame part 12, 13 and 14, 15, respectively, the corresponding end of the cross beam 8 carries an end beam 15*a* extending crosswise with respect to the cross beam, and of which only one is visible in FIG. 3. Each of these end beams is by means of bolts 16 and 17, connected with a supporting plate 18 for the lowermost freezing plate. The upper ends of the bolts extend with clearance through a bracket 19 and 20, respectively, supported by the corresponding end beam 15*a*. The upper ends of the bolts extend with a surplus length up over the corresponding holes and a stop in the form of a nut 22 and 23, respectively, is arranged at the upper end of each bolt.

Figure 3:
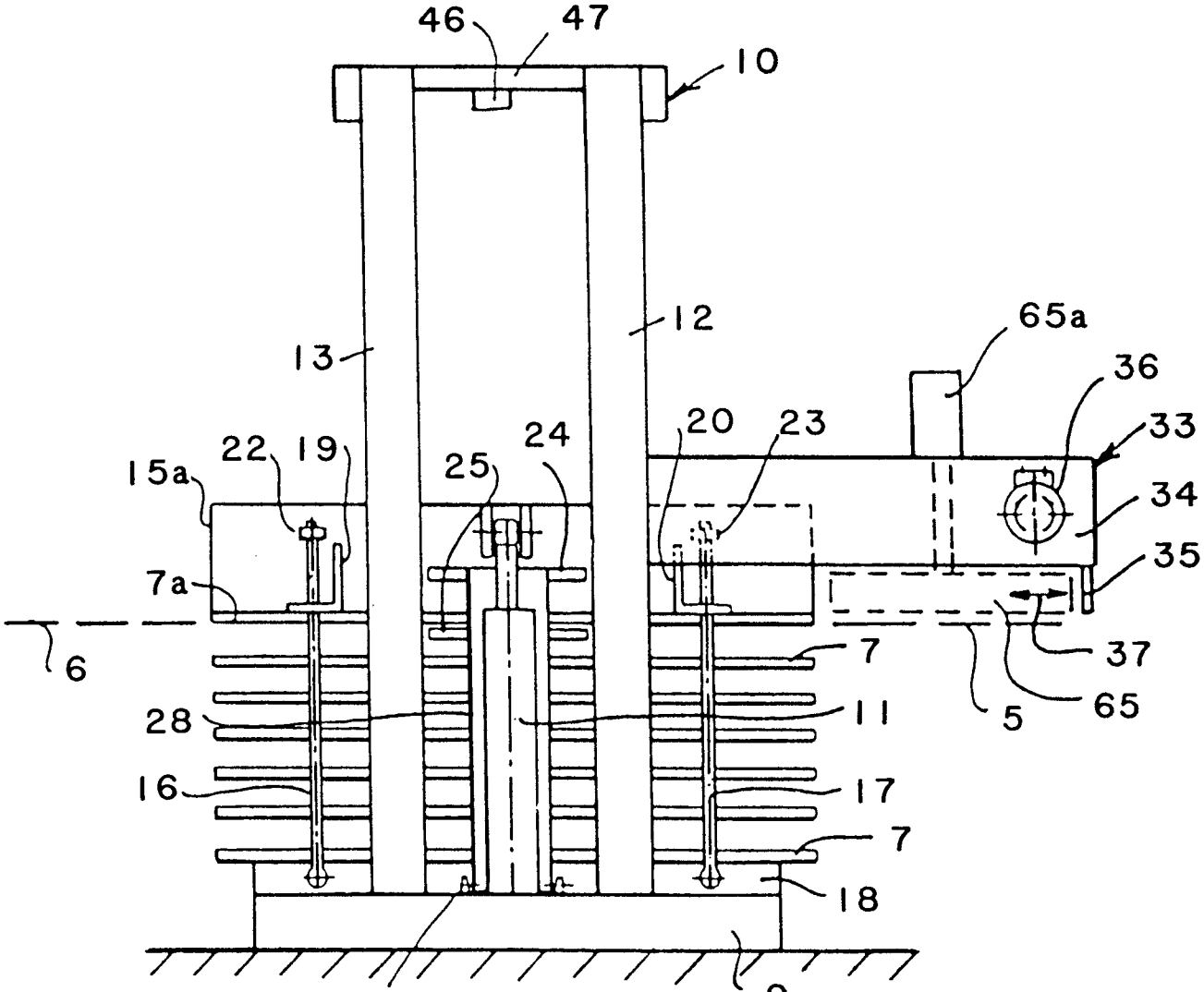
FIG. 3 shows the plate freezer shown in FIG. 2 from the left hand side of FIG. 2.
Figure 4:
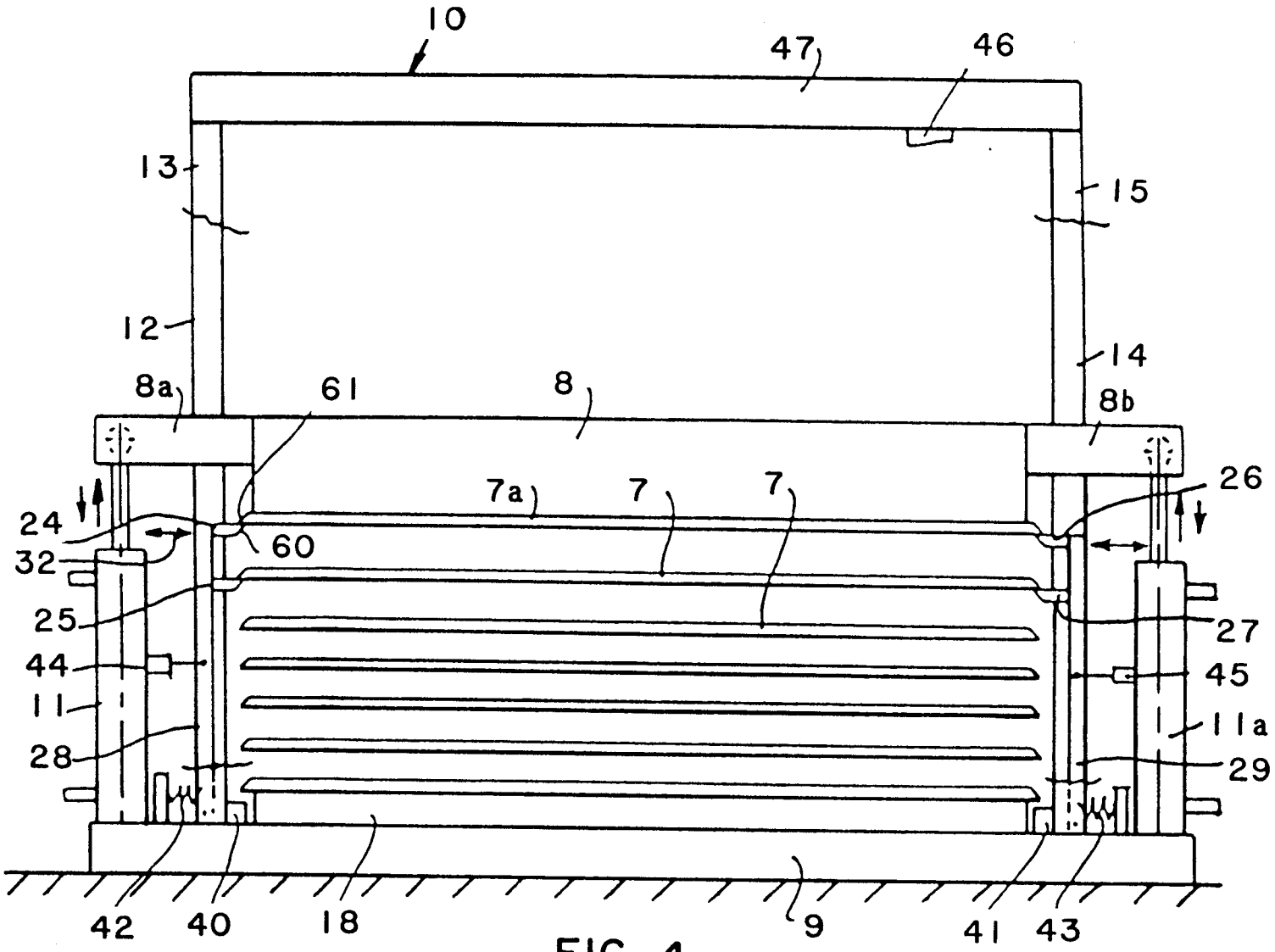
FIG. 4 shows a picture corresponding to FIG. 2 for illustrating the plate freezer during a first step during an emptying/filling operation.
Figure 5:
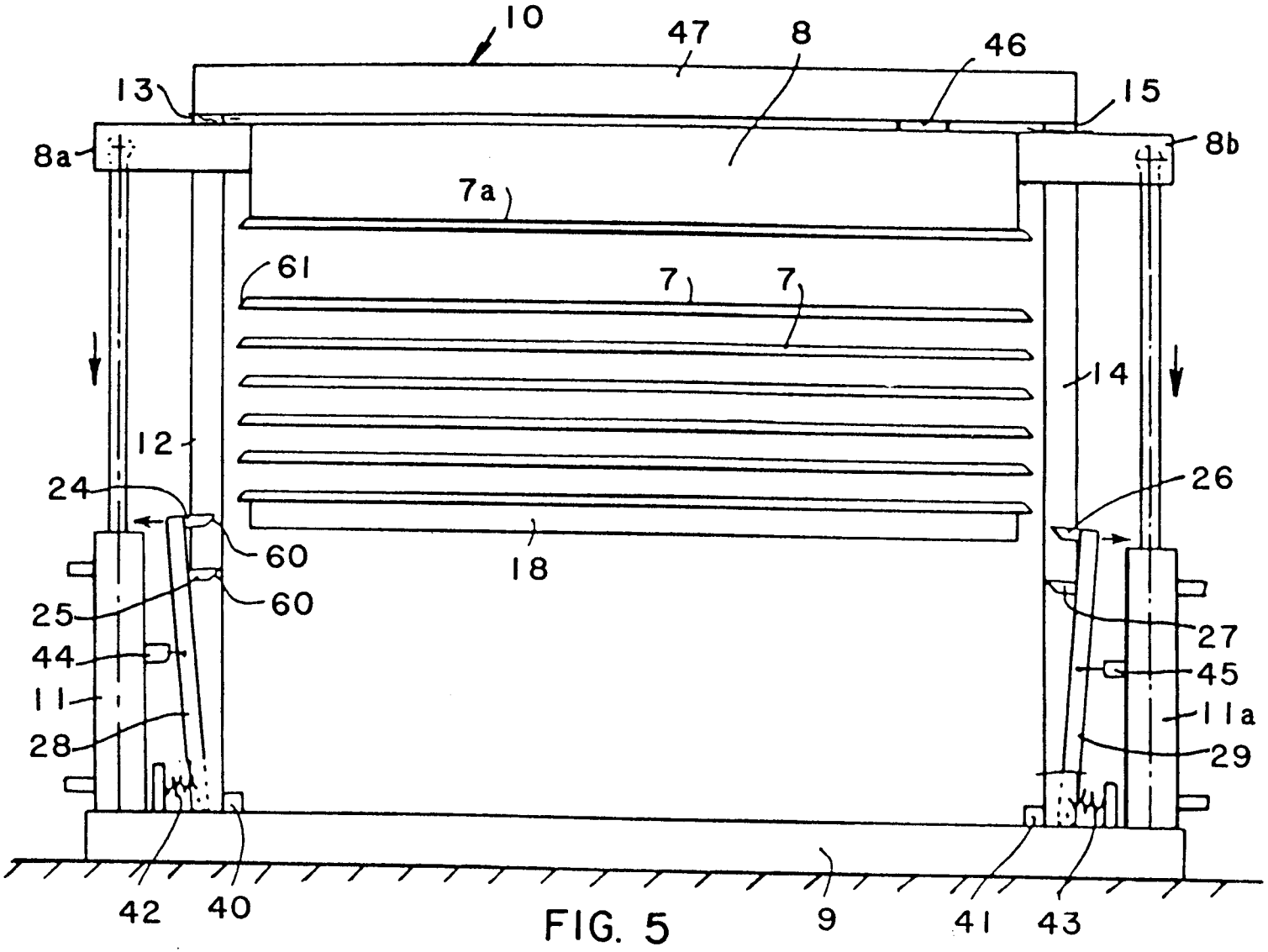
FIG. 5 shows a picture corresponding to FIG. 4 for illustrating a final step after an emptying/filling cycle.

At each end frame part two pawls 24, 25 and 26, 27, respectively, are arranged and each set of pawls is supported by a pawl arm 28 and 29, respectively. The pawl arms are pivotally supported at their lower ends with respect to the basis 9, and the bearing for the pawl arm 28 is shown in FIG. 3 and is designated 30. Accordingly, each pawl arm 28 and 29 may make a small pivot movement as indicated by means of the double arrow 32 in FIG. 4.

As it appears from FIG. 3, the plate freezer shown has a feeding device 33 consisting of two horizontal arms of which only one 34 is shown in FIG. 3. Each of the arms is supported by one of the columns 12 and 14, respectively. This feeding device has been omitted in FIGS. 2, 4 and 5 for the sake of clarity. Between the arms 34 a pushing plate 35 is suspended by means of a pair of chains (not shown) which by means of a motor 36 arranged above the pair of chains may be moved to and from as indicated by means of the double arrow 37 in FIG. 3. The pushing plate 35 has a length which generally corresponds to the length of the freezing plates 7. In FIG. 3 the pushing plate 35 is shown in its outermost position wherein it is positioned above the edge of the feeding conveyor 5, indicated by means of a broken line, facing away from the plate freezer. Also, the removing conveyor 6 is indicated by means of a broken line, and accordingly it will be understood from FIG. 3 that the two conveyors are arranged in the same level as the lowermost pawls 25, 27.

As indicated above, each of the pawl arms 28 and 29 are pivotable in the direction of the double arrow 32. Their pivoting in the inward direction is limited by a stop 40 and 41, respectively, and moreover each of the pawl arms are biased by a pressure spring 42 and 43, respectively, which keep the pawl arms in the positions shown in FIG. 2, but which permit the pawls 24, 25 and 26, 27, respectively, of the pawl arms to pivot outwardly while compressing the springs in question and provided solenoids 44 and 45, respectively, which are arranged one between each of the cylinders 11, 11*a* and the corresponding pawl arms 28 and 29, respectively, are activated by the activation of a contact 46 carried by the uppermost cross beam 47 of the frame 10.

Each of the four plate freezers shown in FIG. 1 is provided with manifolds 48, 49; 50,51; 52, 53 and 54, 55, respectively, which by means of conduits are connected with a distributor 56 arranged in such a way that it can conduct cooling medium to the manifolds 49, 51, 53 and 55 and cause exit of cooling medium from the manifolds 48, 50, 52 and 54 in a controlled way. Moreover, the distributor 56 may conduct thawing up medium, e.g. hot gas to the manifolds 49, 51, 53 and 55 and provide exit for such thawing up medium via the manifolds 48, 50, 52 and 54 also in a controlled way.

Each of the manifolds is connected with each of the plates of the corresponding plate freezer for feeding said plates with cooling medium/thawing loose medium and for removal of cooling medium/thawing up medium. Such connections, preferably, are constituted by flexible reinforced tubes which allow the movement of the freezing plates.

The operation of the plant shown will be further explained below.

It is supposed that the plant shown in FIG. 1 is in operation and that a freezing operation and a thawing loose operation have just taken place as regards the plate freezer 1, and that the plates thereof thereafter have been made inactive controlled by the distributor 36. Now the hydraulic cylinders 11, 11*a* of the plate freezer in question are activated by means of a control system 63 schematically shown in FIG. 2, whereby the cross beam 8 is lifted. Thereby also the uppermost plate 7*a* is lifted, viz. corresponding to the surplus lengths of the bolts 16, 17. Thereafter the remaining plates in the stack are lifted. When the uppermost plate 7*a* passes the pawls 24, 26 the pawl arms 28 and 29 are pivoted outwardly by cooperation between inclined surfaces 60, 61 on the pawls and the plate, respectively. After the passage the pawl arms pivot back to the positions shown in FIG. 2. When the next plate passes the lowermost pawls 25, 27 the same operation occurs. The plate freezer is provided with means (not shown) which when the two uppermost plates have passed each set of pawls operate the control system 63, which now reverses the hydraulic cylinders 11, 11*a* for lowering until the two uppermost plates occupy the positions shown in FIG. 4. A well defined interspace is now provided between the two plates and this interspace is higher than the height of the interspace which the plates had during the freezing due to the surplus lengths of the bolts 16, 17 shown exaggerated in FIG. 3 for the sake of clarity. Accordingly, it will be understood that this surplus movement does not need to be considerably greater than the increase of the interspace to be provided between the plates for emptying and filling thereof. Now the feeding device 33 is activated whereby the corresponding pushing plate 35 pushes a product, which in the meantime has been fed by means of the feeding conveyor 5 and stopped by means of the movable stop 65, FIG. 1, sideways into the interspace provided between the two uppermost plates. This pushing-in movement will simultaneously result in pushing at least a part of the frozen product in the interspace in question out upon the moving conveyor 6, because the two conveyors as previously explained and as it appears from FIG. 3 are arranged exactly aligned with the plate supported by means of the pawls 25 and 27. Now the feeding device 33 by reversing the motor 36 moves the pushing plate 35 back to the position shown in FIG. 3, whereafter a new transfer to the interspace of product which has been fed towards the stop 65 takes place. These operations continue until the frozen product in the interspace concerned has been transferred to the conveyor 6 and product to be frozen has been inserted into the interspace in question from the feeding conveyor 5.

Now the cylinders 11, 11*a* are again activated and in the way explained above the second plate from the top will now be brought to rest upon the pawls 24 and 26, whereas the third plate from the top will be brought to rest upon the pawls 25, 27. Now a new feeding/emptying interspace will be arranged opposite the conveyors and filling and emptying of this interspace is now carried out in the same way as previously explained. These operations continue until the product in the whole stack has been exchanged. At the final lifting step the contact 46 is activated whereby the two solenoids 44 and 45 are activated whereby the pawl arms 28 and 29 are pivoted away from each other to the position shown in FIG. 5. These movements simultaneously affect the control system 63 which reverses the cylinders 11, 11*a* for lowering the whole stack until the stack occupies the position shown in FIG. 2. After this position has been reached the control system 63 will arrange for the applying of a downwardly extending force upon the cross beam 8 by means of the cylinders 11, 11*a* and, accordingly, upon the plate stack in such a way that the product will be put under compression for driving air, if any, out. Then the distributor 56 serves for feeding the freezing plates of the plate freezer in question with cooling medium.

During at least the last part of the exchange cycle explained above thawing loose is arranged for as regards the product frozen in the plate freezer 2 controlled by means of the distributor 56. Now the plate freezer 2 is refilled because the stop 65 is lifted by means of the corresponding solenoid 65*a*, FIG. 3, and the product fed is now stopped by means of the second stop 66. The cycle explained above as regards the plate freezer 1 is now repeated as regards the plate freezer 2, and in this way the operation continues as regards the plate freezers 3 and 4, because also these freezers are provided with movable stops 67 and 68, respectively, corresponding to the stops 65 and 66.

The number of plate freezers belonging to the line in question is equal to one plus the sum of the freezing period and the thawing loose period of a plate freezer divided by the inactive period of the plate freezer. Hereby it is achieved that the plant in question can operate continuously, because one plate freezer always undergoes an emptying/filling cycle while the others operate for freezing and the next plate freezer to be subjected to the filling/emptying cycle undergoes the thawing loose step.

According to the example illustrated on the drawing, four plate freezers are provided. The freezing time plus the thawing loose time according to the example shown for one of the plate freezers is approximately one hour and an emptying/filling cycle takes approximately twenty minutes.

It will be realized that in the drawing a series of plate freezers is shown wherein the number of the plate freezers is at a minimum. However, it may be appropriate to provide the series with one or more further plate freezers in case of shifting over to the freezing of another product or in order to be able to operate the plant in case one or more of the plate freezers should break down.

I claim:

1. An automatically operated freezing plant, comprising a plate freezer comprising a stack of horizontal freezing plates, stepping means for subjecting the stack to a succession of lifting steps each followed by a smaller lowering step in such a manner as to successively place each plate except the uppermost one at a charging and discharging level, while each time detaining the respective upwardly next plate at a distance above the charging and discharging level sufficient to permit the charging of freezing goods from one side of the stack into the enlarged interspace between the two plates considered and the simultaneous discharging of frozen goods from said interspace at the other side of the stack, and for lowering the whole stack to its original position after freezing and after frozen goods have been charged into and discharged from the interspace between the lowermost two plates, characterized in that said plate freezer is combined with a plurality of identical plate freezers to form a series of plate freezers in horizontally aligned arrangement with the charging sides and discharging sides of the stacks situated in common planes, means being provided for automatically:

applying a compressional force to each stack, after it has been lowered to its original position, and concurrently initiating a supply of a freezing medium to each plate of the stack;

maintaining the application of compressional force to the stack and the supply of freezing medium to the plates for a freezing period sufficient to freeze the goods in position between successive plates;

interrupting the supply of freezing medium to the plates and substituting a supply of a thawing medium for a thawing loose period sufficient to thaw the frozen goods loose from the plates;

causing said stepping means to execute a full stepping period finalized by lowering the stack to its original position upon interrupting the application of compressional force to the stack;

mutually timing recurring sequences of said periods for the several stacks in cyclical order in such a manner that the stepping period of each stack is completed during the freezing and thawing up periods of the remaining stacks, the number of stacks being equal to at least one plus the sum of the durations of a freezing period and a thawing loose period of a stack divided by the duration of a stepping period of a stack.

2. A freezing plant as in claim 1, characterized by the provision of a charging and a discharging conveyor running along opposite sides of the horizontally aligned stacks of freezing plates at the charging and discharging level, and reciprocating pushing means for the successive pushing of units of freezing goods from said charging conveyor into the enlarged interspace between freezing plates of the stack at any time performing the stepping period, thereby at the same time to push units of frozen goods already present in said interspace out of the latter to place the units of frozen goods on the discharging conveyor.

3. A freezing plant according to claim 2, characterized in that the pawls are arranged on two pawl arms, which are pivotable for disengaging and engaging the pawls.

4. A freezing plant according to claim 3, characterized in that means are provided for the pawls for holding the pawls disengaged.

5. A freezing plant according to claim 2, characterized in that inclined surfaces are provided on the pawls for cooperation with inclined surfaces on the plates for disengaging the pawls.

6. A freezing plant according to claim 2, characterized in that the lowermost pawls are arranged at a height corresponding to the height of a feeding conveyor of the conveyor system and of a removing conveyor of the conveyor system.

7. A freezing plant according to claim 4, characterized in that each of the plate freezers of the plant is provided with outwardly extending feeding devices projecting above the feeding conveyor and provided with a reciprocably pushing plate.

8. A freezing plant according to claim 7, characterized in that liftable stop means are arranged opposite each plate freezer for stopping on the feeding conveyor products to be fed to the corresponding plate freezer.

* * * * *

UNITED STATES PATENT AND TRADEMARK OFFICE

CERTIFICATE OF CORRECTION

PATENT NO. : 5,040,383

DATED : August 20, 1991

INVENTOR(S) : Klaus GRAM

It is certified that error appears in the above-identified patent and that said Letters Patent is hereby corrected as shown below:

On the title page, Item 30, Foreign Application Priority Data from "October 30, 1987 [DE] Fed. Rep. of Germany 5698/87" to --October 30, 1987 [DK] Denmark 5698/87--.

Signed and Sealed this

Twenty-second Day of December, 1992

*Attest:*

DOUGLAS B. COMER

*Attesting Officer*

*Acting Commissioner of Patents and Trademarks*